United States Patent [19]

Alward et al.

[11] Patent Number: 4,777,307

[45] Date of Patent: Oct. 11, 1988

[54] METHOD FOR IMPROVING THE OXIDATION STABILITY OF REFINED HYDROCARBON OILS

[75] Inventors: Sandra J. Alward, Sarnia; Michael A. Fefer, Whitby, both of Canada

[73] Assignee: Exxon Research and Engineering Company, Florham Park, N.J.

[21] Appl. No.: 132,804

[22] Filed: Dec. 14, 1987

[51] Int. Cl.[4] ..... C07C 7/20

[52] U.S. Cl. ..... 585/2; 252/399; 252/406; 208/48 AA; 585/5

[58] Field of Search ..... 585/2, 5; 252/406, 399; 208/48 AA

[56] References Cited

U.S. PATENT DOCUMENTS

| | | | |
|---|---|---|---|
| 2,185,660 | 1/1940 | Coltof et al. | 252/406 |
| 2,995,569 | 8/1961 | Hamilton et al. | 252/406 |
| 3,052,691 | 9/1962 | Krespan | 585/2 |
| 3,073,844 | 1/1963 | Krespan | 585/2 |
| 3,394,146 | 7/1968 | Hodgson | 252/406 |
| 3,816,312 | 6/1974 | Rossi et al. | 252/406 |
| 4,116,812 | 9/1978 | Godar et al. | 252/406 |

*Primary Examiner*—Asok Pal
*Assistant Examiner*—Helane Myers
*Attorney, Agent, or Firm*—John W. Ditsler

[57] ABSTRACT

The oxidation stability of a refined hydrocarbon oil can be sigificantly improved by adding at least one cyclic sulfide and at least one aromatic compound to said oil.

16 Claims, No Drawings

METHOD FOR IMPROVING THE OXIDATION STABILITY OF REFINED HYDROCARBON OILS

BACKGROUND OF THE INVENTION

1. Field of the Invention

The present invention relates to a method for improving the oxidation stability of a refined hydrocarbon oil by adding a cyclic sulfide and an aromatic compound to said oil.

2. Description of Related Art

Untreated or virgin hydrocarbon oils are frequently refined to enhance the quality of the oil, e.g. remove sulfur, nitrogen and other contaminants. However, an undesirable consequence of the refining process is that the resulting oil becomes depleted in natural oxidation inhibitors such that the refined oil has poor oxidation stability relative to the untreated oil. Accordingly, one or more compounds are normally added to the refined oil to improve its oxidation stability.

Sulfur compounds are known to improve the oxidation stability of low sulfur refined hydrocarbon oils. For example, U.S. Pat. No. 3,345,381 discloses that cyclic sulfides are useful as oxidation inhibitors in rubber chemistry (see also Table 4 of Bell, C. L. M. et al, "Recent Studies in the Aging of Natural Rubber", *Kautschuk und Gummi Kunststoffe*, p. 133–137, 19, Jahrgang, Nr. 3, 1966). Acyclic sulfides (i.e. sulfides in which sulfur is not in a ring) are also known as antioxidants (see Rubinshtein, I. A. et al, "Antioxidation Properties of Organosulfur Compounds and a Criterion For Their Evaluation," *Khim. i Tekhnol, Topliv i Masel*, 45–9 (1965)) as are acyclic sulfides in combination with aromatic hydrocarbons (see U.S. Pat. No. 2,427,766, the disclosure of which is incorporated herein by reference). However, the cyclic and acyclic sulfides normally employed as oxidation inhibitors are quite costly. In addition, the large amounts of sulfides which are required tend to promote the formation of sludge.

Accordingly, it would be desirable to have available a simple and convenient, yet relatively inexpensive, method for reducing the amount of sulfides required while obtaining effective oxidation stability.

SUMMARY OF THE INVENTION

Now according to the present invention, it has been discovered that when at least one cyclic sulfide and at least one aromatic compound having at least three condensed aromatic rings are added to a refined hydrocarbon oil, there results in an unexpected increase in the oxidation stability of said oil. The improved oxidation stability obtained is due to a synergism between the two additives which is not attained with similar quantities of either additive alone. In a preferred embodiment, the cyclic sulfide will have at least a five member ring in which one or more independent sulfur atoms are present in said ring.

DETAILED DESCRIPTION OF THE INVENTION

The terms "refined hydrocarbon oil" and "refined hydrocarbon oils" as used herein refer to a hydrocarbon oil or oils (from either natural sources or synthetically produced) which has undergone treatment or refinement in some manner to improve the properties of the unrefined oil. However, during such treatment, the oil becomes depleted in sulfur compounds (i.e. aromatic sulfur-containing compounds, acyclic sulfides and cyclic sulfides) and substantially depleted in sulfur in the form of cyclic sulfides, i.e. the amount of sulfur in the form of cyclic sulfides is reduced to 100 wppm or less and often less than 50 wppm. Refined hydrocarbon oils can be produced in any number of ways including by extraction, hydrofining, hydrocracking, hydroisomerization, etc. or by a combination of such treatments. Thus, refined hydrocarbon oils suitable for use in the present invention include hydrocrackate, wax isomerates, polyalphaolefins and mixtures thereof.

The cyclic sulfides used in the present invention will contain at least three (preferably at least five) members, at least one of which is an independent sulfur atom, and should contain at least one hydrogen atom on the carbon atom in the Beta position relative to the sulfur atoms. By "member" is meant the number of atoms in the ring without reference to the type of atom therein. By "carbon atom in the Beta position" is meant the carbon atom in the second position, or in the position once removed, from the sulfur atom. The following schematics illustrate what is meant by "member" and "carbon atom in the Beta position" for three to six member rings:

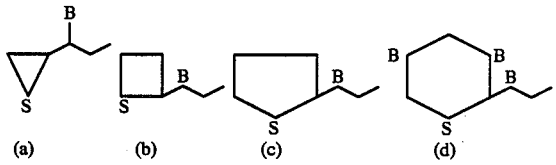

Although (a)-(d) illustrate rings in which only one sulfur atom is present, two or more sulfur atoms may be present in the ring provided they are independent; i.e., the sulfur atoms are not adjacent to one another.

One or more hydrocarbon sidechains may also be attached to the carbon/sulfur ring. For three, four and five member rings, a sidechain is required and should be attached to the carbon atom adjacent to the sulfur atom in said ring. For six member rings and larger, a sidechain is not required—the Beta position can be part of the ring as shown in (d) above. The sidechains may contain at least one alkyl group having from 1 to about 30 (preferably from about 12 to about 18) carbon atoms, at least one alkylaryl group having from 7 to about 30 (preferably from about 10 to about 18) carbon atoms or mixtures thereof. The alkyl and alkylaryl groups can be linear or branched. Other hydrocarbon compounds (e.g. aromatics, alkylaromatics and alkyls) could also be present in the sidechain.

Examples of cyclic sulfides which can be suitably employed in the present invention include alkyl and aryl substituted thiocyclopentanes; alkyl, aryl and alkylaryl thiocyclohexanes; paraffin wax polythio-dimers as defined in U.S. Pat. No. 2,346,156 or mixtures thereof. Cyclic sulfides can be prepared by a number of convenient methods as illustrated in U.S. Pat. Nos. 2,346,156 and 3,345,381, the disclosures of which are incorporated herein by reference.

The cyclic sulfides used herein may also contain metallic constituents. In general, salts of the alkaline-earth metals (calcium, barium, magnesium and strontium) are preferred although other polyvalent metals such as Cu, Zn, Al, Pb, Fe, Ni, Co, Mn, Cr and Sn may be employed. Salts of the alkali metals (sodium, potassium and lithium) may also find application. Illustrative salts are metallic phenates, carboxylates, phosphates, thiophosphates, etc. Such salts also have detergent properties when used in lubricating compositions for internal combustion engines. However, when the cyclic sulfides are employed only for their antioxidant properties, the nonmetallic rather than the metallic compounds are preferred. So as not to be corrosive, the sulfides should be free from halogen substituents.

Aromatic compounds useful in combination with the above-illustrated cyclic sulfides are oil-soluble polynuclear hydrocarbons having at least three, preferably from three to eight, and more preferably from three to four condensed aromatic rings. Examples of aromatic compounds that can suitably be employed in the present invention include anthracenes, phenanthrenes, pyrenes or mixtures thereof. The aromatic compounds used herein may also contain one or more hydrocarbon groups as sidechains, preferably alkyl hydrocarbon groups having from 1 to 10 carbon atoms.

The aromatic hydrocarbons used herein may be obtained by a number of methods including synthesis (i.e. alkylating anthracene with low-carbon olefins such as ethylene, propylene, etc.) or from highly cracked hydrocarbons oils such as purified relatively high-boiling aromatic fractions obtained from solvent extracting lube oil distillates.

The aromatic hydrocarbons used herein should have an initial boiling point above about 500° F. They may be further separated into fractions of different aromaticities by solvent extraction, fractional precipitation, etc. For example, cracked distillates may be extracted with a solvent from aromatics, such as liquid sulfur dioxide, N-methyl pyrollidone, furfural, nitrobenzene, phenol, aniline, acetone, dichlordiethyl ether, etc. alone or if desired, in counter-current with liquid propane, butane, pentane, etc.

The amount of cyclic sulfides and aromatic hydrocarbons employed in the present invention is not critical and, therefore, can range broadly. Typically, the amount of sulfur in the form of cyclic sulfides will range from about 0.001 to about 1.0 wt.%, preferably from about 0.005 to about 0.5 wt.%. Similarly, the amount of aromatic hydrocarbons that can be used with the cyclic sulfide can range broadly but, typically, will range from above 0.5 to 10 or more wt.%, preferably from about 0.5 to about 4 wt.%.

The present invention will be further understood by reference to the following examples which are not intended to restrict the claims appended hereto.

The properties of the hydrocracked base oil, prehydrotreated aromatic extract and slack wax isomerate base oil used in the examples which follow are summarized in Table 1 below:

TABLE 1

| | H/C Base Oil | Aromatic Extract | Isomerate Base Oil |
|---|---|---|---|
| Viscosity at 40° C., cSt. | 32.66 | 49.03 | 28.82 |
| Viscosity at 100° C., cSt. | 5.48 | 5.19 | 5.77 |
| Viscosity Index | 103 | −40 | 147 |
| Pour Point, °C. | −18 | — | −15 |
| Gas Chromatograph Dist., °C. (ASTM D2887) | | | |
| 5% | 352 | 305 | 351 |
| 50% | 429 | 392 | 457 |
| 95% | 499 | 459 | 583 |
| Volatility at 375° C., % | — | 37 | 10.5 |
| Sulfur, wt % | 0 | 0.12 | 0.039 |
| Basic Nitrogen, wppm | <2 | 77.5 | <2 |
| Saturates, wt % | 99.1 | 15.8 | 97.9 |
| Aromatics, wt % | 1.0 | 80.5 | 2.2 |

TABLE 1-continued

| | H/C Base Oil | Aromatic Extract | Isomerate Base Oil |
|---|---|---|---|
| Recovery, wt % | 100.2 | 96.3 | — |
| Alkyl Benzenes, wt % | — | 13.09 | — |
| 1-Ring Naphtheno Aromatics, wt % | — | 18.55 | — |
| 2-Ring Aromatics, wt % | — | 24.17 | — |
| 3-Ring Aromatics, wt % | — | 13.56 | — |
| 4+ Ring Aromatics, wt % | — | 7.60 | — |

In Examples 2–16 which follow, the oxidation stability of the hydrocarbon oil samples was determined by a modified IP 306 test in which dry oxygen is passed for 48 hours at 1 liter/hour into a reaction tube containing the oil and a solid copper catalyst. The tube and its contents are immersed in a suitable aluminum block heater (or oil bath) maintained at 120° C. The volatile acids driven off by the flowing oxygen are absorbed in water. The volatile and oil-soluble acidities, and the sludge produced in the oil are determined at the completion of the test. The Total Oxidation Product (which is a measure of the amount of oxidation products formed) was then calculated using the following equation:

$$TOP\ \% = S + \frac{180(SA + VA)}{561}$$

wherein:

VA=volatile acidity, mg KOH/g

SA=soluble acidity, mg KOH/g

S=total sludge, wt.% and 180 in the numerator is the average molecular weight of oil oxidation acids.

EXAMPLE 1

Preparation of 2-n-dodecyltetrahydrothiophene (a cyclic sulfide having a five member ring).

A solution of tetrahydrothiophene-1, 1-dioxide (36.0 g, Aldrich #T2,220-9) in dry tetrahydrofuran (800 ml, Aldrich #18,656-2) was cooled to −78° C. (dry-ice acetone bath) and treated dropwise with 2.6 molar n-butyllithium in hexane (115 ml, Aldrich #23,070-7). The mixture was stirred for 20 minutes after which 1-bromododecane (72 ml, Aldrich #14,578-5) was added in one portion and the solution stirred for an additional 6 hours at −78° C. The mixture was then allowed to warm to room temperature and stirred overnight. The mixture was cooled to 0° C. and treated carefully with water (500 ml) to destroy any remaining butyllithium. The resulting mixture was diluted with ether (500 ml) and placed in a separatory funnel (2000 ml). The aqueous phase was further extracted with ether (twice with 500 ml). The ether phases were washed with water (500 ml) and brine (500 ml). The combined ether extracts were dried over anhydrous magnesium sulphate, filtered and evaporated on a rotary evaporator to form a solid (84.5 g)

The solid reaction mixture was dissolved in toluene (25 ml) and purified by column chromatography using approximately 900 g of silica gel (100–200 mesh) as adsorbant and the following solvents:

1000 ml hexane 1000 ml 2% ether in hexane 1000 ml 4% ether in hexane 1000 ml 8% ether in hexane 4000 ml 16% ether in hexane
3000 ml ethyl acetate The following fractions were obtained as a result of the above procedure:

Fractions 1–100 were 80 ml
Fractions 101–103 were 1000 ml

Fractions 100–103 were combined and the solvent evaporated to yield the 2-n-dodecyltetrahydrothiophene-1, 1-dioxide (63.3 g, 73% yield).

A solution of the 2-n-dodecyltetrahydrothiophene-1, 1-dioxide thus prepared (2.78 g) in toluene (6 ml) was added dropwise over 10 minutes to a solution of 1 molar diisobutylaluminum hydride (30 ml, Aldrich #21,500-7) in toluene. The solution was refluxed for 46 hours. The reaction mixture was cooled in an ice bath to 0° C. and treated carefully with ethanol (1 ml) and then with a solution of water (4 ml) in hydrochloric acid (3 ml). The reaction mixture was then placed in a separatory funnel and the aqueous layer was removed and washed with toluene (twice with 40 ml). The toluene fractions were combined, dried over anhydrous $MgSO_4$, filtered and evaporated on a rotary evaporator to yield 2.34 g of crude product which was purified by flash chromatography using 230–400 mesh silica gel as adsorbant and hexane as eluant. Fraction sizes were 80 ml. The 2-n-dodecyltetrahydrothiophene was contained in fractions 2–4 (2.02 g, 82% yield).

EXAMPLE 2

No additives

A 25 g sample of the hydrocracked base oil was oxidized in the copper catalysed IP 306 oxidation test. The total oxidation products were determined to be 18.9 wt.%.

EXAMPLE 3

3-ring aromatic compound added

The aromatic extract (0.6 g, 2 wt.%) was added to the hydrocracked base oil (29.5 g) and the mixture stirred with a magnetic stir bar to give a homogeneous solution. A 25 g aliquot was oxidized in the copper catalysed IP 306 oxidation test. The total oxidation products were determined to be 13.2 wt.%.

EXAMPLE 4

Cyclic sulfide added

A 0.024 g sample (0.01 wt.% sulfur) of the 2-n-dodecyltetrahydrothiophene prepared in Example 1 was added to about 30 g of the hydrocracked base oil and the mixture stirred to give a homogeneous solution. A 25 g aliquot was oxidized in the copper catalysed IP 306 oxidation test. The total oxidation products were determined to be 18.6 wt.%.

EXAMPLE 5

Acyclic sulfide added

A 0.035 sample (0.01 wt.% sulfur) of di-n-dodecylsulfide (purchased from ICN Pharmaceuticals Inc.) was added to about 30 g of the hydrocracked base oil and the mixture stirred to give a homogeneous solution. A 25 g aliquot was oxidized in the copper catalysed IP 306 oxidation test. The total oxidation products were determined to be 20.2 wt.%.

EXAMPLE 6

Acyclic sulfide and 3-ring aromatic compound added

A sample of di-n-dodecylsulfide (0.035 g) and aromatic extract (0.6 g) was added to the hydrocracked base oil (29.4 g) and the mixture stirred to give a homogeneous solution. A 25 g aliquot was oxidized in the copper catalysed IP 306 oxidation test. The total oxidation products were determined to be 10.3 wt.%.

EXAMPLE 7

Cyclic sulfide and 3-ring aromatic compound added

A sample of the 2-n-dodecyltetrahydrothiophene (0.024 g) prepared in Example 1 and the aromatic extract (0.6 g) was added to the hydrocracked base oil (29.4 g) and the mixture stirred to give a homogeneous solution. A 25 g aliquot was oxidized in the copper catalysed IP 306 oxidation test. The total oxidation products were determined to be 0.25 wt.%.

EXAMPLE 8

Cyclic sulfide and 3-ring aromatic compound added

A 0.24 g sample (0.1 wt.% sulfur) of the 2-n-dodecyltetrahydrothiophene prepared in Example 1 and the aromatic extract (0.6 g) was added to the hydrocracked base oil (29.2 g) and the mixture stirred to give a homogeneous solution. A 25 g aliquot was oxidized in the copper catalysed IP 306 oxidation test. The total oxidation products were determined to be 0.12 wt.%.

EXAMPLE 9

Cyclic sulfide and 3-ring aromatic compound added

Example 8 was repeated using 0.012 g (0.005 wt.% sulfur) of 2-n-dodecyltetrahydrothiophene, 0.6 g of aromatic extract and 29.4 g of hydrocracked base oil. The total oxidation products were determined to be 0.17 wt.%.

EXAMPLE 10

Cyclic sulfide and 3-ring aromatic compound added

Example 8 was repeated using 0.012 g of 2-n-dodecyltetrahydrothiophene, 0.15 g (0.5 wt.%) of aromatic extract and 29.8 g of hydrocracked base oil. The total oxidation products were determined to be 14.9 wt.%.

EXAMPLE 11

Cyclic sulfide and 3-ring aromatic compound added

Example 8 was repeated using 0.024 g of 2-n-dodecyltetrahydrothiophene, 0.3 g (1.0 wt.%) of aromatic extent and 29.7 g of hydrocracked base oil. The total oxidation products were determined to be 0.27 wt.%.

EXAMPLE 12

Acyclic sulfide and 3-ring aromatic compound added

A sample of di-n-dodecyl sulphide (0.035 g) and aromatic extract (0.3 g) was added to the hydrocracked base oil (29.7 g) and the mixture stirred to give a homogeneous solution. A 25 g aliquot was oxidized in the copper catalysed IP 306 oxidation test. The total oxidation products were determined to be 13.3 wt.%.

EXAMPLE 13

No additive

A 25 g sample of the slack wax isomerate base oil was oxidized in the copper catalysed IP 306 oxidation test. The total oxidation products were determined to be 13.8 wt.%.

EXAMPLE 14

2-ring aromatic compound added

A 0.6 g sample of alkylated naphthalene (an aromatic compound having two condensed aromatic rings) was added to 29.4 g of isomerate base oil and the mixture stirred to give a homogeneous solution. A 25 g aliquot was oxidized in the copper catalysed IP 306 oxidation test. The total oxidation products were determined to be 10.4 wt.%.

EXAMPLE 15

Cyclic sulfide added

A sample of 2-n-dodecyltetrahydrothiophene (0.024 g) was added to the isomerate base oil (30 g) and the mixture stirred to give a homogeneous solution. A 25 g aliquot was oxidized in the copper catalysed IP 306 oxidation test. The total oxidation products were determined to be 11.1 wt.%.

EXAMPLE 16

Cyclic sulfide and 2-ring aromatic compound added

A sample of 2-n-dodecyltetrahydrothiophene (0.024 g) and alkylated naphthalene (0.6 g) was added to the isomerate base oil (29.4 g) and the mixture stirred to give a homogeneous solution. A 25 g aliquot was oxidized in the copper catalysed IP 306 oxidation test. The total oxidation products were determined to be 6.8 wt.%.

The results of the tests performed in Examples 2–16 are summarized in Table 2 below:

TABLE 2

| Example | Base Oil | Aromatic Extract, wt. % | Sulfur, Wt. % Cyclic Sulfides | Sulfur, Wt. % Acyclic Sulfides | TOP, % |
|---|---|---|---|---|---|
| 2 | H/C | — | — | — | 18.9 |
| 3 | H/C | 2.0 | — | — | 13.2 |
| 4 | H/C | — | 0.01 | — | 18.6 |
| 5 | H/C | — | — | 0.01 | 20.2 |
| 6 | H/C | 2.0 | — | 0.01 | 10.3 |
| 7 | H/C | 2.0 | 0.01 | — | 0.25 |
| 8 | H/C | 2.0 | 0.1 | — | 0.12 |
| 9 | H/C | 2.0 | 0.005 | — | 0.17 |
| 10 | H/C | 0.5 | 0.005 | — | 14.9 |
| 11 | H/C | 1.0 | 0.01 | — | 0.27 |
| 12 | H/C | 1.0 | — | 0.01 | 13.3 |
| 13 | Isom. | — | — | — | 13.8 |
| 14 | Isom. | 2.0 | — | — | 10.4 |
| 15 | Isom. | — | 0.01 | — | 11.1 |
| 16 | Isom. | 2.0 | 0.01 | — | 6.8 |

Examples 2–9, 11 and 12 show that a significant increase in oxidation stability occurs only when a cyclic sulfide and an aromatic compound having at least 3 condensed aromatic rings are added to the base oil. The result is not obtained when a similar amount of each additive is used separately. Examples 13–16 show that aromatic compounds having only two condensed aromatic rings, alone or in combination with a cyclic sulfide, are not effective in increasing the oxidation stability of a refined hydrocarbon oil. Example 10 shows that greater than 0.5 wt.% aromatic compounds must be present to improve the oxidation stability of said oil.

What is claimed is:

1. A method for improving the oxidation stability of a refined hydrocarbon oil which comprises adding to said oil (a) at least one aromatic compound having at least three condensed aromatic rings, and (b) at least one cyclic sulfide having at least three members, one or more of which is an independent sulfur atom, and at least one hydrogen atom on a carbon atom in the Beta position relative to said sulfur atom, wherein said cyclic sulfide has a hydrocarbon sidechain attached to the carbon adjacent to the sulfur atom when said sulfide contains between three and five members.

2. The method of claim 1 wherein said cyclic sulfide contains at least a five member ring.

3. The method of claim 2 wherein said cyclic sulfide contains at least six members.

4. The method of claim 3 wherein said sidechain contains at least one alkyl group having from 1 to about 30 carbon atoms, at least one alkylaryl group having from 7 to about 30 carbon atoms or mixtures thereof.

5. The method of claim 1 wherein said aromatic compound has from three to eight condensed aromatic rings.

6. The method of claim 5 wherein said aromatic compound has at least one sidechain containing at least one hydrocarbon group.

7. A method for improving the oxidation stability of a refined hydrocarbon oil which comprises adding to said oil (a) from above 0.5 wt.% to about 10 wt.% of at least one aromatic compound having from three to eight condensed aromatic rings, and (b) from about 0.001 to about 1 wt.% of sulfur in the form of at least one cyclic sulfide having at least three members, one or more of which is an independent sulfur atom, and at least one hydrogen atom on a carbon atom in the Beta position relative to said sulfur atom, wherein said cyclic sulfide has a hydrocarbon sidechain attached to the carbon adjacent to the sulfur atom when said sulfide contains between three and five members.

8. The method of claim 7 wherein the amount of aromatic compound ranges from above 0.5 to about 4 wt.%.

9. The method of claim 8 wherein the amount of sulfur in the form of cyclic sulfide ranges from about 0.005 to about 0.5 wt.%.

10. The method of claim 7 wherein said cyclic sulfide contains at least five members.

11. The method of claim 10 wherein said cyclic sulfide contains at least six members.

12. The method of claim 11 wherein said sidechain contains at least one alkyl group having from 1 to about 30 carbon atoms, at least one alkylaryl group having from 7 to about 30 carbon atoms or mixtures thereof.

13. The method of claim 7 wherein said aromatic compound has from 3 to 4 condensed aromatic rings.

14. The method of claim 13 wherein said aromatic compound is selected from the group consisting of anthracenes, phenanthrenes, pyrenes and mixtures thereof.

15. The method of claim 14 wherein said aromatic compound contains at least one sidechain containing an alkyl hydrocarbon having from 1 to 10 carbon atoms.

16. The method of claim 7 wherein said aromatic compound contains at least one sidechain containing an alkyl hydrocarbon having from 1 to 10 carbon atoms.

* * * * *